United States Patent [19]

Denny

[11] B 3,983,349

[45] Sept. 28, 1976

[54] ELECTRICAL SWITCH

[75] Inventor: Dann W. Denny, Morrison, Ill.

[73] Assignee: General Electric Company, Fort Wayne, Ind.

[22] Filed: May 2, 1974

[21] Appl. No.: 466,390

[44] Published under the second Trial Voluntary Protest Program on February 24, 1976 as document No. B 466,390.

[52] U.S. Cl. ..... 200/339; 200/290

[51] Int. Cl.[2] ..... H01H 19/14

[58] Field of Search ..... 200/339, 159 A, 67 DA, 200/67 DB, 67 D, 153 K, 250, 290

[56] References Cited

UNITED STATES PATENTS

| | | | |
|---|---|---|---|
| 2,599,437 | 6/1952 | Dickson | 200/67 DB |
| 3,067,301 | 12/1962 | Yamamoto | 200/67 DB |
| 3,519,775 | 7/1970 | Weremy | 200/153 K |
| 3,668,353 | 6/1972 | Raab | 200/153 K |
| 3,694,607 | 9/1972 | Fontana | 200/339 |
| 3,749,872 | 7/1973 | Foster | 200/159 A X |
| 3,763,341 | 10/1973 | Willis | 200/67 DB X |

*Primary Examiner*—Robert K. Schaffer
*Assistant Examiner*—William J. Smith
*Attorney, Agent, or Firm*—Joseph E. Papin

[57] ABSTRACT

An electrical switch has a housing, and means is adapted to be selectively movable in the housing for operating the electrical switch. Means having a deflected portion therein is engaged between the housing and the operating means for yielding generally as a collapsible column to oppose the selective movement of the operating means.

15 Claims, 6 Drawing Figures

ELECTRICAL SWITCH

BACKGROUND OF THE INVENTION

This invention relates in general to an electrical switch and in particular to those of a momentary toggle operated type.

In the past, various types of momentary toggle operated electrical switches have been employed in apparatus, such as a clothes dryer for instance, to initiate the operation thereof. Generally, momentary toggle operated switches were connected in a motor starting circuit for an electric motor, such as that which might be utilized to drive a clothes dryer, and the momentary toggle switch was manually or selectively momentarily operated to initiate the starting cycle of the electric motor. Upon the energization of the electric motor, the toggle switch could be released since, once started, the electric motor would continue to run.

In some of the past momentary toggle operated electrical switches, a torsion return spring was mounted on the pivot pin about which the toggle was pivoted, and the torsion spring had opposite arms which were loaded upon pivotal movements of the toggle to effect the return thereof to its original or centered position. One of the disadvantageous or undesirable features of this type of past switch was that the return spring thereof created relatively high frictions which affected the toggling action.

In another of the past momentary toggle operated electrical switches, a horseshoe or generally U-shaped spring was employed to resiliently return the toggle to its mid-position upon the pivotal movement thereof to operate the electrical switch. One of the disadvantageous or undesirable features of this type of past switch was that it was necessary to fixedly mount the horseshoe shaped return spring to the switch body which deleteriously affected the cost thereof.

In another of the past momentary toggle operated electrical switches, the toggle was operable against a pair of oppositely acting switch blades having contacts thereon for engagement with stationary contacts within the switch body, and the resilient switch blades were respectively operable to return the toggle to its normal mid-position in the switch body. One of the disadvantageous features of this type of past switch was that the switch blades were a part of an electrical circuit which, in effect, dictated the size of the switch blades for its current carrying capacity.

In yet another past toggle operated electrical switch, a pair of leaf type springs each acted on the toggle to maintain it in one of its opposite displaced positions; however, one of the disadvantageous or undesirable features of this type of past switch was that it involved rather high frictions to maintain the toggle in its displaced position. Additionally there was no return of the toggle to a preselected position.

SUMMARY OF THE INVENTION

Among the several objects of the present invention may be noted the provision of a momentary toggle operated electrical switch which overcomes the aforementioned disadvantageous or undesirable features discussed hereinabove, as well as others, with respect to the past switches; the provision of a momentary toggle operated electrical switch in which the friction of its return spring per se and also that involved between the return spring and the toggle upon actuation thereof is minimal; the provision of a momentary toggle operated electrical switch in which the return spring acting on the toggle affords a very even torque in opposition to the operation of the toggle; the provision of a momentary toggle operated electrical switch in which the return spring thereof yields generally as a collapsible column in opposition to movement of the toggle; the provision of a momentary toggle operated electrical switch in which the return spring thereof is maintained against displacement from the switch housing only by its engagement between the housing and the toggle; and the provision of a momentary toggle operated electrical switch which is simplistic in design, economical to manufacture, and easily assembled.

In general, an electrical switch in one form of the invention has a housing, and means for controlling a circuit through the housing is operable generally between circuit making and breaking positions. Means electrically disassociated from the controlling means is adapted to be selectively momentarily movable in the housing for operating the controlling means, and means is provided for yielding generally as a collapsible column to oppose the selective momentary movement of the operating means. The yielding means includes a pair of generally opposite portions respectively mounted between the housing and the operating means to bias the operating means against the controlling means urging it toward one of its circuit making and breaking positions, and a permanent bend in the yielding means for determining the magnitude range of the compressive force of the yielding means in opposition to a momentarily applied force on the operating means to effect the selective momentary movement thereof against the yielding means. The controlling means assumes the other of its circuit making and breaking positions upon the selective momentary movement of the operating means against the compressive force of the yielding means.

Also in general and in one form of the invention, an electrical switch has a housing with a chamber therein, and means in the chamber for controlling a circuit through the housing is operable generally between circuit making and breaking positions. A toggle mounted to the housing about a pivoting axis is adapted to be momentarily pivoted in response to an applied force thereon, and the toggle includes: means within the chamber electrically disassociated from the controlling means and conjointly movable with the toggle for effecting the operation of the controlling means; a spring disposed at least in part within the chamber including a pair of opposite portions engaged between the housing and the toggle; and a permanently bent portion between the opposite portions wherein the spring yields generally as a collapsible column about the bent portion in response to the momentary pivoting of the toggle. A seat is provided on the housing for engagement with the toggle, and one of the opposite portions exerts a force on the toggle to urge the operation effecting means toward engagement with the seat wherein the operation effecting means urges the controlling means from one of its circuit making and breaking position toward the other thereof.

Further in general, an electrical switch in one form of the invention has a housing, and means for controlling a circuit through the housing is operable generally between circuit making and breaking positions. Means is mounted to the housing about a pivoting axis for operating the controlling means, and means is mounted between the housing and the operating means for yielding generally as a collapsible column and exerting a force on the operating means thereby to establish a moment with respect to its pivoting axis effective to bias the operating means against the controlling means urging it toward one of its circuit making and breaking positions. The operating means is movable about its pivoting axis in response to a momentarily applied force toward a momentarily actuated position effectively reducing the moment of the exerted force with respect to the pivoting axis, and the exerted force is increased by the yielding means as it yields in response to the momentary applied force pivoting of the operating means to its momentarily actuated position thereby to compensate at least in part for the reduction of the moment of the exerted force. The controlling means is urged toward the other of its circuit making and breaking positions upon the momentary applied force pivoting of the operating means toward its momentarily actuated position and against the yielding means.

Still further and in one form of the invention, an electrical switch has a housing, an abutment in the housing, and a pair of spaced terminals mounted in the housing. A stationary contact is provided on one of the terminals, and a resilient current carrying switch blade is mounted to the other of the terminals including a movable contact for making and breaking engagement with the stationary contact. A toggle is pivotally mounted to the housing about a pivoting axis and includes an arm pivotally movable therewith in the housing for engagement with the abutment and for actuating engagement with the switch blade, and a generally columnar spring includes a generally thin strip of resilient material having a pair of opposite portions. A pair of means is provided on the housing and the toggle for respectively seating the opposite portions of the spring, and one of the opposite portions exerts a force on the toggle thereby to establish a moment with respect to the pivoting axis normally biasing the arm into engagement with the abutment and the resilient switch blade to break the movable contact from the stationary contact. The toggle is pivotally movable in response to a momentary applied force thereon about the pivoting axis toward a position effectively reducing the moment of the exerted force and disengaging the arm from the abutment and the switch blade, and the resiliency of the switch blade urges it to make the movable contact with the stationary contact upon the disengagement therefrom of the arm. A permanent bend is provided in the elongate strip between the opposite portions thereof about which the spring yields, and the exerted force is increased as the spring yields in response to the momentary applied force pivoting of the toggle to compensate at least in part for the reduction of the moment of the exerted force so that the torque of the momentary applied force pivoting of the toggle may be generally constant.

BRIEF DESCRIPTION OF THE DRAWINGS

Corresponding reference characters indicate corresponding parts throughout the several views of the drawings.

The following examples are disclosed merely to illustrate the invention and are not to be construed as limiting in any manner.

DESCRIPTION OF THE PREFERRED EMBODIMENTS

Figure 1:
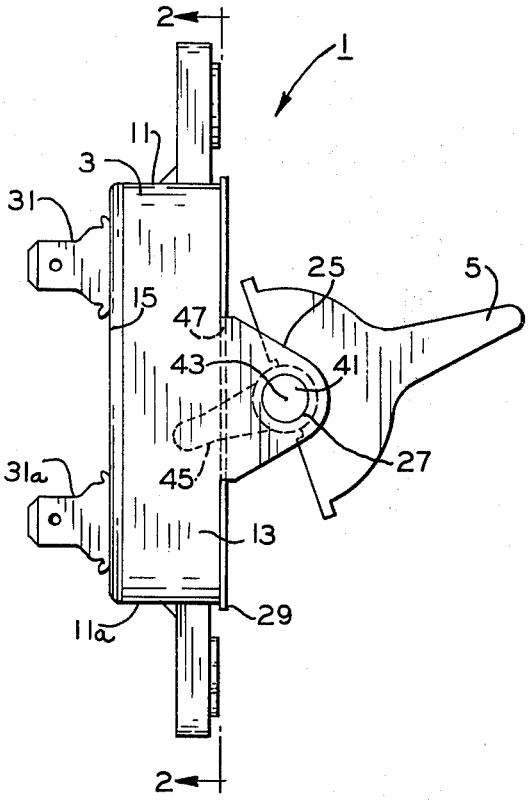
FIG. 1 is a side elevational view of an electrical switch in one form of the invention.

Referring now to the drawings in general, there is shown at 1 an electrical switch in one form of the invention having a housing 3, and means, such as a toggle or trigger 5, is adapted to be selectively movable in the housing between opposite positions for operating the electrical switch (FIG. 1). Means, such as a leaf or distorted columnar type return spring 7, has a deflected portion, such as a permanent bend 9, therein and is engaged between housing 3 and operating means or toggle 5 for yielding generally as a collapsible column in opposition to the selective movement of the toggle from one of its opposite positions toward the other thereof (FIG. 3).

By way of illustration, a collapsible column may be defined generally as an elongate beam or column having opposed and generally equal forces directed against the opposite ends of the beam. Of course, such beams are relatively stiff members which will resist relatively high values of such opposed forces until deflection or bending occurs in such beams. After beam deflection, the values of the opposed forces necessary to effect further deflection of the beam will decrease appreciably.

Figure 2:
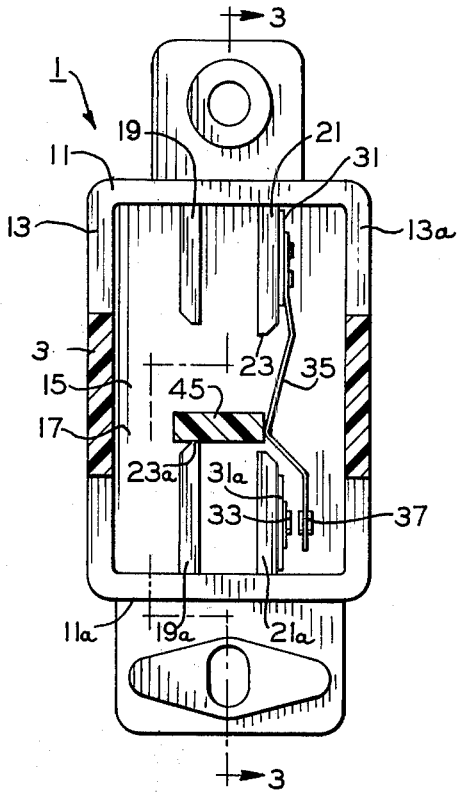
FIG. 2 is a sectional view taken generally along line 2—2 of FIG. 1.
Figure 3:
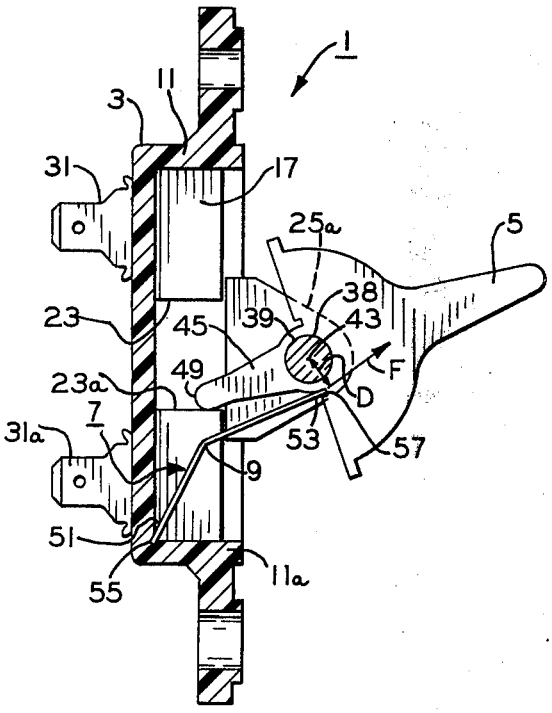
FIG. 3 is a sectional view taken along line 3—3 of FIG. 2.

More particularly and with reference to FIGS. 1–3, housing 3 of electrical switch 1 is provided with a pair of opposite end walls **11, 11*a* integrally interconnected between a pair of opposite side walls 13, 13*a*, and a base wall 15 is integrally formed with both the end walls and side walls. A chamber 17 is defined in housing 3 between housing base wall 15 and opposite end walls 11, 11*a* and side walls 13, 13*a*. Opposite pairs of intermediate walls 19, 19*a* and 21, 21*a* are integrally formed between end walls 11, 11*a* and base wall 15, and the intermediate wall pairs are laterally spaced from each other between side walls 13, 13*a*. Intermediate walls 19*a* and 21 each have free or distal ends defining opposite abutments 23, 23*a* within housing chamber 15 for engagement with toggle 5, as discussed hereinafter. A pair of extensions 25, 25*a* are integrally formed with side walls 13, 13*a* adjacent the mid-portions thereof extending generally upwardly or away from base wall 15, and a pair of generally coaxial bearing openings or apertures 27, 27*a* are provided in the extensions. A closure member, such as a cover or plate 29, is releasably secured to housing 3 by suitable means (not shown) engaging with the free or upper marginal surfaces of opposite end walls 11, 11*a* and side walls 13, 13*a* thereby to close housing chamber 17**.

A pair of terminals **31, 31*a* are integrally molded or otherwise mounted to housing base wall 15, and the interior ends of the terminals within housing chamber 17 are disposed on or adjacent to intermediate wall pair 21, 21*a* respectively. A stationary contact 33 is welded or otherwise fixedly mounted to the interior end of terminal 31*a*, and a resilient switch blade 35 has mounted on one end thereof a movable contact 37 for making and breaking engagement with the stationary contact while the other end of the switch blade is fixedly connected by rivets or other suitable means to the interior end of terminal 31. Although only one set of contacts 33, 37 and actuating switch blade 35 is shown, it is contemplated that at least another set of contacts and another switch blade may be provided for operation in electrical switch 1** within the scope of the invention.

Toggle 5 is provided with a bore 38 therethrough in which is received a shaft 39 providing a pair of oppositely extending trunnions 41, 41*a* which are rotatably or pivotally received in openings 27, 27*a* provided therefore in side wall extensions 25, 25*a*, and it may be noted that the shaft has a pivoting axis 43 about which the toggle is pivotally movable. A blade arm or extension 45, which is integrally formed with toggle 5 for operating or actuating engagement with switch blade 35, extends generally downwardly through an opening 47 in housing cover 29 into housing chamber 17, and the toggle extension has a distal or free end or end portion 49 for engagement with opposite abutments 23, 23*a* on housing intermediate 21, 19*a* thereby to predeterminately limit pivotal movement of the toggle about its pivoting axis 43.

Figure 4:
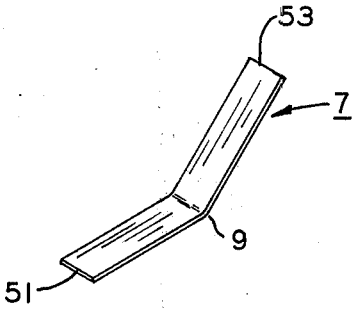
FIG. 4 is a perspective view of a return spring for the electrical switch of FIG. 1.

Referring now to FIGS. 3 and 4, columnar return spring 7 is formed from a relatively thin strip of resilient material, such as spring steel or the like, and the columnar return spring is provided with a pair of opposite portions or ends 51, 53 which are generally spaced equidistantly from deflected portion or bend 9 provided in the columnar return spring. Although not shown, it is contemplated that bend 9 could be provided at other distances from ends 51, 53 within the scope of the invention. One end 51 of columnar return spring 7 is releasably received in means for containing engagement therewith, such as a slot or groove 55 generally, at the juncture of housing base wall 15 and end wall 11, and the other end 53 of the columnar return spring is also releasably received in means for containing engagement therewith, such as a cooperating slot or groove 57 in, toggle 5. Albeit not shown, it is contemplated that the columnar return spring end 51 could be located in a corner between housing base wall 15 and end wall 11*a*, and the spring end 53 could be biased against another type of abutment on toggle 5. In this manner, columnar return spring 7 is biased between housing 3 and toggle 5 and acts to exert a force F (as indicated by an arrow in FIG. 3) on the toggle for pivoting or urging it toward its normal or at-rest position in which toggle extension 45 is engaged with abutment 23*a* on intermediate wall 19*a*, of the housing. It may be noted that force F is exerted by columnar return spring 7 on toggle 5 in its at-rest position at a distance D generally radially spaced from pivoting axis 43 of the toggle thereby to establish a moment with respect to the pivoting axis which affords a very even torque upon manual operation of the toggle, as discussed hereinafter in detail. It may also be noted that columnar return spring 7 acts as a collapsible column, as defined hereinabove, having its opposite ends 51, 53 loaded, and bend or bent portion 9 of the columnar return spring thereby determines the magnitudes of force F, or range thereof, at which the return spring is operble to afford operation or pivotal movement of toggle 5 in response to relatively light operating forces applied to the toggle. In addition to the foregoing, it may also be noted that there is relatively little inherent friction in columnar return spring 7, and friction between the spring and cooperating component parts with which it is engaged is minimal.

In the operation of electrical switch 3 with the component parts thereof positioned as described hereinabove and as shown in the drawings, a selective or manually applied force on toggle 5 pivots or moves it in a generally clockwise direction (as seen in FIGS. 1 and 3) about its pivoting axis 43 and against force F of columnar return spring 7. Upon such clockwise movement of toggle 5, it may be noted that the compressive force F of columnar return spring 7 increases since opposite end portions 51, 53 are, in effect, being moved closer to each other, and it may also be noted distance D is decreased upon the clockwise movement of the toggle D thereby to reduce the moment of force F with respect to pivoting axis 43 of toggle 5. Therefore, even though the moment of force F is reduced due to the decrease of distance D bend 9 in spring 7 acts to, in effect, predeterminately increase force F as the return spring is deflected in response to the manual applied force actuation of toggle 5 thereby to maintain the torque acting on toggle 5 generally the same at all times against the manually applied force acting on the toggle to effect the clockwise movement thereof. As the end portions 51, 53 of columnar return spring 7 are further loaded against housing 3 and toggle 5 in response to the applied force movement thereof, it may be noted that the columnar return spring deflects or yields generally at bend 9 thereof; therefore, the columnar return spring yields generally as a collapsible column in response to the applied force movement of the toggle.

When toggle 5 is pivotally displaced about its pivoting axis 43 in response to the applied manual force acting thereon, abutment end 49 of toggle extension 45 is disengaged from abutment 23*a* on housing intermediate wall 19*a* and urged toward abutting or motion, travel or stroke limiting engagement with the opposite abutment 23 on housing intermediate wall 23. During this pivotal movement or travel of toggle 5, extension 45 thereof is moved past a position effecting its disengagement from switch blade 35. Upon the disengagement of toggle extension 45 from switch blade 35, the inherent resiliency of the switch blade urges it leftwardly (as seen in FIG. 2) to engage movable contact 37 with stationary contact 33. Of course, such making enagagement of movable and stationary contacts 37, 33 may be effective to complete an electrical circuit (not shown) across electrical switch 1 through terminals 31, 31*a*, switch blade 35, and the contacts.

Upon the release of the manual force applied on toggle 5, force F of columnar return spring 7 urges the toggle from its displaced or switch energizing or actuating position with toggle extension 45 engaged with abutment 23 on housing intermediate wall 21 toward the at-rest position of the toggle wherein the extension thereof is re-engaged with abutment 23*a* on housing intermediate wall 19*a*. During such return movement of toggle 5 about its pivoting axis 43 to its at-rest position, toggle extension 45 re-engages switch blade 35 moving it toward the position thereof, as seen in FIG. 2, with movable contact 37 disengaged from stationary contact 33 thereby to interrupt the electrical circuit across electrical switch 1.

Figure 5:
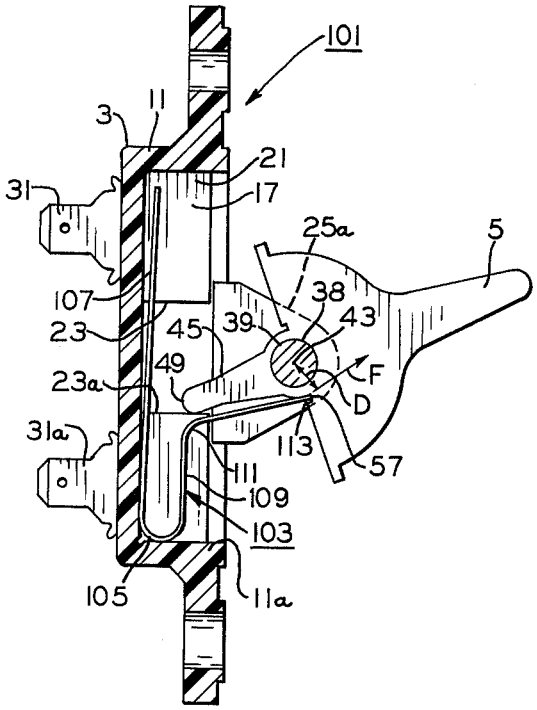
FIG. 5 is a sectional view illustrating an alternative electrical switch in one form of the invention.
Figure 6:
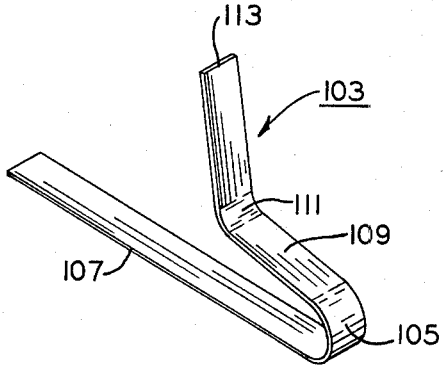
FIG. 6 is a perspective view of illustrating a return spring of the electrical switch of FIG. 5.

Referring now to FIG. 5, another or an alternative momentary toggle operated electrical switch in one form of the invention 101 is shown therein having generally the same component parts and functioning generally in the same manner as the previously described electrical switch 1 with the exceptions noted hereinafter; however, it may be noted that electrical switch 101 may have at least some distinct advantageous features in addition to those set forth hereinabove with respect to electrical switch 1.

Electrical switch 101 is provided with an alternative means, such as a leaf or distorted columnar type return spring 103, which is disposed generally within housing chamber 17 in engagement between housing 3 and toggle 5 for also yielding generally as a collapsible column in opposition to the selective or manual movement of the toggle from one of its opposite positions toward the other thereof.

Columnar return spring 103 has generally a U-shaped configuration and is formed from a relatively thin strip of resilient material, such as spring steel or the like, and the columnar return spring is provided with a generally U-shaped or bight portion 105 integrally interposed between a pair of arms 107, 109. Arm 107 is generally straight, and arm 109 has a deflected portion or bend 111 therein. It may be noted that columnar return spring 103 is provided with opposite portions generally constituted by U-shaped portion 105 and a free end portion 113, and bend 111 is disposed generally equidistantly between the U-shaped portion and the free end portion of the columnar return spring. Albeit not shown, bend 111 could be provided at other distance from U-shaped portion 105 and free end portion 113 within the scope of the invention. Arm 107 is provided for seating or positioning engagement with housing base wall 15 between intermediate walls **19, 19*a* and 21, 21*a* to maintain arm 109 predeterminately disposed or positioned for ready and easy engagement with toggle 5 during the assembly of electrical switch 1. Upon assembly of columnar return spring 103 within chamber 17 of housing 3, arm 107 is generally displaced from housing base wall 15, and such displacement is occasioned in response to the loading or biasing of U-shaped portion 105 and free end portion 113 of the columnar return spring between housing 3 and toggle 5 upon the assembly of electrical switch 1. Free end portion 113 is releasably received in cooperating slot 57 provided therefor in toggle 5, and it may be noted that the inherent resiliency of columnar return spring 103 urges U-shaped portion 105 generally toward wedging engagement between housing base wall 15 and housing end wall 11*a* thereby to predeterminately position columnar return spring generally within housing 3. In this manner, columnar return spring 103 acts to exert force F (as indicated by an arrow in FIG. 5) on toggle 5 for pivoting or urging it toward its at-rest position in which toggle extension 45 is engaged with abutment 23*a* on housing intermediate wall 19*a*. It may be noted that force F is exerted by columnar return spring 103 on toggle 5 at a distance D generally radially spaced from pivoting axis 43 of the toggle thereby to establish a moment which affords a very even torque upon manual operation of the toggle, as discussed hereinafter. It may also be noted that columnar return spring 103 acts as a collapsible column, as defined hereinbefore, having its opposite portions 109, 113 loaded, and bend 113 of the columnar return spring yields thereby to increase force F generally commensurately with the reduction of its moment, to affort the generally even torque operation or pivotal movement of toggle 5** in response to a relatively light operating or manual force applied thereto.

In the operation of electrical switch 101 with the component parts thereof positioned as described hereinabove and as shown in the drawings, a selective or manually applied force on toggle 5 pivots it in a generally clockwise direction (as seen in FIG. 5) about its pivoting axis 43 thereby to increase spring force F since end portion 113 is moved closer to U-shaped portion 105 with bend 111 yielding. Even though spring force F increases, it is accompanied by a decrease in the moment thereby since distance D is decreased which, in effect, acts to maintain the torque acting on toggle 5 generally the same at all times against the manually applied force on the toggle. It may be noted that columnar return spring 103 deflects or yields generally at bend 111 in response to the loading forces on portions 105, 113 wherein the columnar return spring yields generally as a collapsible columnar.

Since actuation of switch blade 35 by toggle 5 is generally the same for both electrical switches 1, 101, the description thereof with respect to electrical switch 101 is omitted for the sake of brevity. Of course, pivotal movement of toggle 5 in response to the manually applied force moves toggle extension into stroke or travel limiting engagement with abutment 23, and upon the release of the manually applied force, the compressive force of columnar return spring 103 effects return pivotal movement of the toggle to re-engage the extension thereof with abutment **23*a***.

From the foregoing, it is now apparent that novel electrical switches 1, 101 are provided meeting the objects and advantageous features set out hereinbefore, as well as others, and that the precise construction, shapes and details of these electrical switches may be changed by those skilled in the art without departing from the spirit of the invention or the scope thereof which is set out in the claims which follow.

What I claim as new and desire to secure by Letters Patent of the United States is:

1. An electrical switch comprising a housing, means for controlling a circuit through the housing and operable generally between circuit making and breaking positions, means electrically disassociated from the controlling means and adapted to be selectively momentarily movable in the housing for operating the controlling means, and means for yielding generally as a collapsible column to oppose the selective momentary movement of the operating means including a pair of generally opposite portions respectively mounted between the housing and the operating means to bias the operating means against the controlling means urging it toward one of its circuit making and breaking positions, and a permanent bend in the yielding means for determining the magnitude range of the compressive force of the yielding means in opposition to a momentarily applied force on the operating means to effect the selective momentary movement thereof against the yielding means, and the controlling means assuming the other of its circuit making and breaking positions upon the selective momentary movement of the operating means against the compressive force of the yielding means.

2. An electrical switch as set forth in claim 1, further comprising means on the housing for seating the operating means in its at-rest position in response to the biasing action of the yielding means thereon.

3. An electrical switch as set forth in claim 1, further comprising a chamber within the housing, and the yielding means being mounted in the chamber and releasably retained against displacement therefrom at least in part by the engagement of the opposite portions of the yielding means with the housing and the operating means, respectively.

4. An electrical switch as set forth in claim 1, further comprising means on the operating means for containing engagement with one of the opposite portions of the yielding means.

5. An electrical switch as set forth in claim 1, further comprising means in the housing for containing engagement with one of the opposite portions of the yielding means.

6. An electrical switch as set forth in claim 1, wherein the operating means includes means for pivotally mounting it to the housing, the yielding means exerting its compressive force on the operating means to establish a moment with respect to the pivot axis thereof wherein the selective momentary pivotal movement of the operating means in response to the momentary applied force is operable to reduce the magnitude of the moment, and the yielding means also being operable generally upon the deflection thereof to increase its compressive force and compensate at least in part for the reduction in the moment.

7. An electrical switch comprising a housing having a chamber therein, means in the chamber for controlling a circuit through the housing and operable generally between circuit making and breaking positions, a toggle mounted to the housing about a pivoting axis and adapted to be momentarily pivoted in response to an applied force thereon, the toggle including means within the chamber electrically disassociated from the controlling means and conjointly movable with the toggle for effecting the operation of the controlling means, a spring disposed at least in part within the chamber including a pair of opposite portions engaged between the housing and the toggle, and a permanently bent portion between the opposite portions wherein the spring yields generally as a collapsible column about the bent portion in response to the momentary pivoting of the toggle, and a seat on the housing for engagement with the toggle, one of the opposite portions exerting a force on the toggle to urge the operation effecting means toward engagement with the seat wherein the operation effecting means urges the controlling means from one of its circuit making and breaking position toward the other thereof.

8. An electrical switch comprising a housing, means for controlling a circuit through the housing and operable generally between circuit making and breaking positions, means mounted to the housing about a pivoting axis for operating the controlling means, means mounted between the housing and the operating means for yielding generally as a collapsible column and exerting a force on the operating means thereby to establish a moment with respect to its pivoting axis effective to bias the operating means against the controlling means urging it toward one of its circuit making and breaking positions, the operating means being movable about its pivoting axis in response to a momentarily applied force toward a momentarily actuated position effectively reducing the moment of the exerted force with respect to the pivoting axis and the exerted force being increased by the yielding means as it yields in response to the momentary applied force pivoting of the operating means to its momentarily actuated position thereby to compensate at least in part for the reduction of the moment of the exerted force, and the controlling means being urged toward the other of its circuit making and breaking positions upon the momentary applied force pivoting of the operating means toward its momentarily actuated position and against the yielding means.

9. An electrical switch as set forth in claim 8, wherein the controlling means is generally constituted by a resilient switch blade mounted in the housing.

10. An electrical switch as set forth in claim 9, wherein the switch blade includes a movable contact, and a stationary contact mounted in the housing, the switch blade being movable toward its circuit making position to engage the movable contact with the stationary contact upon the momentary applied force pivoting of the operating means.

11. An electrical switch as set forth in claim 8, wherein the operating means is generally constituted by a toggle for actuating engagement with the controlling means, the toggle being biased in response to the exerted force of the yielding means into engagement with the controlling means to maintain it in the one of its circuit making and breaking positions, and the momentary applied force pivoting of the toggle being effective to disengage it from the controlling means wherein it then assumes the other of its circuit making and breaking positions.

12. An electrical switch as set forth in claim 8, wherein the yielding means is generally constituted by a generally columnar spring having a pair of opposite portions in loading engagement with the housing and the toggle.

13. An electrical switch as set forth in claim 8, wherein the yielding means includes a permanently distorted portion about which the yielding means is yieldable, the permanently distorted portion being effective to predetermine the magnitude range of the exerted force when the yielding means yields in response to the momentary applied force pivoting of the operating means.

14. An electrical switch as set forth in claim 12, wherein the columnar spring includes a permanent bend between the opposite portions about which the spring yields, the bend being effective to determine the range of the exerted force upon the yielding of the spring about the bend in response to the momentary applied force pivoting of the operating means.

15. An electrical switch comprising a housing, an abutment in the housing, a pair of spaced terminals mounted in the housing, a stationary contact on one of the terminals, a resilient current carrying switch blade mounted to the other of the terminals including a movable contact for making and breaking engagement with the stationary contact, a toggle pviotally mounted to the housing about a pivoting axis including an arm pivotally movable therewith in the housing for engagement with the abutment and for actuating engagement with the switch blade, a generally columnar spring including a generally thin strip of resilient material having a pair of opposite portions, a pair of means on the housing and the toggle for respectively seating the opposite portions of the spring, one of the opposite portions exerting a force on the toggle thereby to establish a moment with respect to the pivoting axis normally biasing the arm into engagement with the abutment and the resilient switch blade to break the movable contact from the stationary contact, the toggle being pivotally movable in response to a momentary applied force thereon about the pivoting axis toward a position effectively reducing the moment of the exerted force and disengaging the arm from the abutment and the switch blade, the resiliency of the switch blade urging it to make the movable contact with the stationary contact upon the disengagement therefrom of the arm, and a permanent bend in the elongate strip between the opposite portions thereof about which the spring yields, the exerted force being increased as the spring yields in response to the momentary applied force pivoting of the toggle to compensate at least in part for the reduction of the moment of the exerted force so that the torque of the momentary applied force pivoting of the toggle may be generally constant.

* * * * *